US006458442B1

(12) United States Patent
McKay

(10) Patent No.: US 6,458,442 B1
(45) Date of Patent: Oct. 1, 2002

(54) CLEANING MAT WITH A PLURALITY OF DISPOSABLE SHEETS

(76) Inventor: William D. McKay, G-9082 S. Saginaw, Grand Blanc, MI (US) 48439

( * ) Notice: Subject to any disclaimer, the term of this patent is extended or adjusted under 35 U.S.C. 154(b) by 0 days.

(21) Appl. No.: 09/599,307

(22) Filed: Jun. 22, 2000

(51) Int. Cl.[7] ..... A47L 23/22

(52) U.S. Cl. ..... 428/40.1; 428/41.9; 428/101; 428/343; 428/352; 15/104.93; 15/215; 15/216

(58) Field of Search ..... 428/40.1, 41.9, 428/101, 343, 352; 15/215, 216, 104.93

(56) References Cited

U.S. PATENT DOCUMENTS

| | | | | | |
|---|---|---|---|---|---|
| 4,107,811 | A | * | 8/1978 | Imsande | 15/215 |
| 5,658,270 | A | * | 8/1997 | Lichstein | 604/387 |
| 5,674,341 | A | * | 10/1997 | Ng | 156/234 |
| 5,910,137 | A | * | 6/1999 | Clark et al. | 604/387 |
| 6,017,454 | A | * | 1/2000 | Horl et al. | 210/321.68 |
| 6,233,776 | B1 | * | 5/2001 | Blum et al. | 15/215 |

* cited by examiner

*Primary Examiner*—Michael Barr
*Assistant Examiner*—Elena Tsoy
(74) *Attorney, Agent, or Firm*—Gifford, Krass, Groh, Sprinkle, Anderson & Citkowski, P.C.

(57) ABSTRACT

A cleaning mat according to the present invention is designed to be placed on a floor and to clean the undersides of shoes, feet, and other objects. The cleaning pad includes a base sheet, which is designed to rest on the floor. The base sheet has an upper surface and lower surface with the lower surface designed to contact the floor. Multiple removable and disposable cleaning sheets are supported in a stacked configuration on the upper surface of the base sheet. Each of the cleaning sheets includes an upper bibulous layer having an upper face. The bibulous layer is designed to absorb liquid from an object that contacts the upper face. Each cleaning sheet also includes a lower moisture barrier layer that has an upper face adjacent the bibulous layer. The barrier layer is operative to prevent transport of liquid from the bibulous layer to other cleaning sheets below the barrier layer. In some embodiments, an adhesive covers a portion of the upper face of the upper bibulous layer and is designed to grab and retain dirt and debris that comes into contact with the upper face. A portion of the upper face remains non-occluded such that absorbency is maintained. In other embodiments, a plurality of perforations are provided through the upper bibulous layer to retain debris. In yet other embodiments, the moisture barrier layer extends beyond the edges of the bibulous layer to define a perimeter surrounding the bibulous layer. The perimeter of each of the cleaning sheets may be bonded together with adhesive so as to seal in unexposed bibulous layers.

20 Claims, 4 Drawing Sheets

CLEANING MAT WITH A PLURALITY OF DISPOSABLE SHEETS

FIELD OF THE INVENTION

The present invention relates generally to rugs and cleaning mats and, more specifically, to a cleaning mat with a plurality of removable and disposable cleaning sheets.

BACKGROUND OF THE INVENTION

As people, pets, and objects move from place to place, their feet or wheels often pick up dirt and debris, which is carried along as they move. The dirt and debris is thereby spread to other places, such as the interiors of houses, offices, and hospitals. Obviously, it is desirable to prevent the spread of dirt and debris, and many attempts have been made to do so. Chief among these are rugs and mats that are placed in the entryways of homes, offices, and hospitals. It is hoped that these rugs or mats will remove and retain some of the dirt and debris from the shoes and wheels of people, pets, and objects. However, this is often not the case. In many situations, these rugs and mats are not frequently or sufficiently cleaned and are themselves a source of dirt and debris. Also, even a clean rug or mat often does a poor job of removing dirt and debris from feet and wheels. These mats and rugs also preferably remove liquid from feet and wheels. However, they often do an insufficient job of this as well. They may have limited absorption and may also become quickly wetted where they no longer can absorb additional liquid.

The problem of dirt and debris on the shoes of people is especially worrisome in hospital operating room and manufacturing clean room facilities. For these purposes, "tacky mats" have been developed. These mats typically consist of a plurality of layers of thin plastic with adhesive coated on the upper surface of each layer. In theory, a person walks across the mat and the adhesive grabs the dirt and debris from the underside of their shoes. Once the mat is sufficiently covered with dirt and debris, the soiled layer is peeled from the remaining layers to expose a fresh layer with fresh adhesive. Examples of these types of mats are disclosed and explained in U.S. Pat. Nos. 4,107,811 to Imsande and 4,559,250 to Paige. While this type of mat may have limited applicability, it suffers from numerous shortcomings. The plastic layers easily tear when removed and also require users to carefully walk across them to avoid tearing in use. The adhesive on the layers only removes dirt and debris that is lightly attached to the underside of the shoes. If the shoes are more heavily soiled, it is impossible for the user to wipe their feet, since doing so would likely tear the plastic sheet. Probably the most serious drawback of this type of mats is that they are absolutely incapable of absorbing liquids from the bottom of shoes. Therefore, they are only suited for applications where it is known that the shoes are already dry. Therefore, the mats cannot be used in entryways to buildings where shoes may be heavily soiled and/or wet.

A slight improvement is provided by a tacky mat disclosed and explained in U.S. Pat. No. 3,665,543 to Nappi. In this version, a gauze sheet is embedded in the adhesive layer and fully saturated with adhesive. The gauze sheet serves the dual purposes of strengthening the plastic underlayer and providing a rougher upper surface to improve retention of dirt and debris. However, this mat still fails to address the need to absorb liquids. It also is only suitable for very light wiping since the gauze layer is insubstantial.

A different approach to the mat or rug problem is taken by U.S. Pat. Nos. 5,506,040 and 5,834,104 to Cordani and U.S. Pat. No. 5,173,346 to Middleton. In each of these patents, an absorbent layer overlies a moisture barrier layer. The absorbent layer absorbs liquid and the moisture barrier layer prevents the liquid from transferring out of the mat. In the case of the Middleton patent, the absorbent mat is designed to catch and absorb fluids which drip from an operating table during surgery. Therefore, the absorbent layer is highly absorbent and retentive of fluid, but is not designed to be walked across as with a normal rug or mat used in an entryway. The Cordani patents disclose mats which are designed for use in entryways. Therefore, the absorbent layer is designed to be walked across and absorbs liquid and tolerates at least some wiping of shoes. However, the Cordani mats lack the tackiness of the previously discussed "tacky mats" and therefore have limited capability to grab dirt and debris from the shoes of people walking over the mat. Also, the Cordani mats are only a single layer and therefore lack the functionality of the plurality of sheets used in a typical tacky mat. A significant advantage to the stacked tacky mats is that users may very easily "clean" the mat by simply peeling off and disposing of the uppermost layer. With the Cordani mats, the entire mat must be replaced. This discourages "cleaning."

In light of the above, there remains a need for a cleaning mat or rug which encourages users to "clean" the mat whenever the mat becomes soiled, is capable of tolerating wiping, absorbs liquids, and has the capability to grab and retain dirt and debris.

SUMMARY OF THE INVENTION

The present invention overcomes many of the shortcomings of the prior art. A cleaning mat according to the present invention is designed to be placed on a floor and to clean the undersides of shoes, feet, and other objects. The cleaning pad includes a base sheet which is designed to rest on the floor. The base sheet has an upper surface and lower surface with the lower surface designed to contact the floor. Multiple removable and disposable cleaning sheets are supported in a stacked configuration on the upper surface of the base sheet. Each of the cleaning sheets includes an upper bibulous layer having an upper face. The bibulous layer is designed to absorb liquid from an object which contacts the upper face. Each cleaning sheet also includes a lower moisture barrier layer which has an upper face adjacent the bibulous layer. The barrier layer is operative to prevent transport of liquid from the bibulous layer to other cleaning sheets below the barrier layer. In some embodiments, an adhesive covers a portion of the upper face of the upper bibulous layer and is designed to grab and retain dirt and debris that comes into contact with the upper face. A portion of the upper face remains non-occluded such that absorbency is maintained. In other embodiments, a plurality of perforations are provided through the upper bibulous layer to retain debris. In yet other embodiments, the moisture barrier layer extends beyond the edges of the bibulous layer to define a perimeter surrounding the bibulous layer. The perimeter of each of the cleaning sheets may be bonded together with adhesive so as to seal in unexposed bibulous layers.

DETAILED DESCRIPTION OF THE PREFERRED EMBODIMENTS

Figure 1:
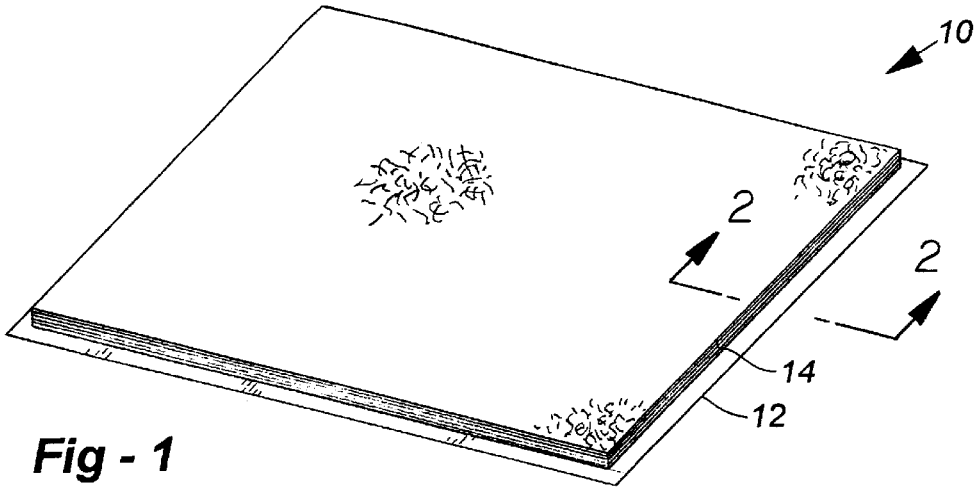
FIG. 1 is a perspective view of a first embodiment of a cleaning mat according to the present invention.
Figure 2:
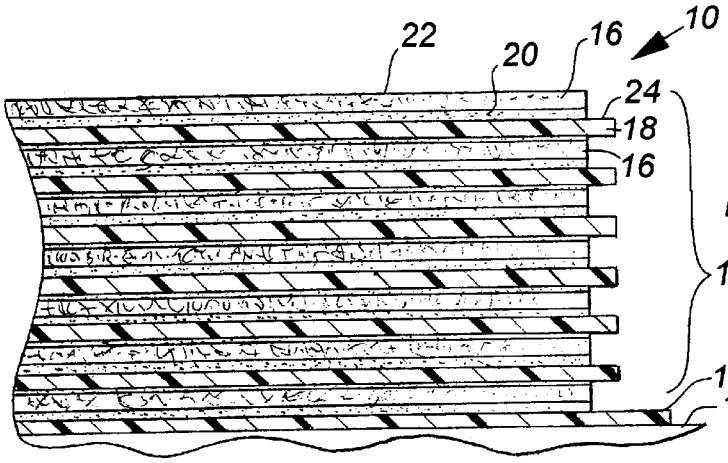
FIG. 2 is a cross-sectional view of a portion of the cleaning mat of FIG. 1 taken along lines 2—2.

Referring to FIGS. 1 and 2, a first embodiment of a cleaning mat according to the present invention is generally shown at 10. The cleaning mat 10 is designed to be positioned on a floor such as in an entryway of a house or office. It is sized to be sufficiently large such that the person walking across the mat may easily step on an upper surface of the mat and clean their feet. As will be clear to those of skill in the art, the size and shape of the mat 10 may vary depending on the application. The mat 10 preferably includes a base sheet 12 which is designed to lay on the floor 13. The base sheet 12 has a lower surface which contacts the floor 13 and an upper surface which faces away from the floor 13. A plurality of removable and disposable cleaning sheets 14 is supported in a stacked configuration on the upper surface of the base sheet 12.

As best shown in FIG. 2, each of the cleaning sheets includes an upper bibulous layer 16 and a lower moisture barrier layer 18. The bibulous layer 16 and moisture barrier layer 18 are preferably bonded to one another such as by adhesive 20. The bibulous layer 16 is designed to absorb liquid from a shoe or object which contacts its upper face 22. Therefore, when a person walks across the uppermost cleaning sheet and contacts the upper face 22 of the uppermost bibulous layer 16, the bibulous layer 16 absorbs liquid from the person's shoes. Also, the bibulous layer is preferably tough enough to withstand wiping of shoes on its upper surface 22. As will be clear to those of skill in the art, the bibulous layer 16 may be constructed from any of a variety of materials. For example, non-woven substrates such as spunlace, airlaid, wet laid, rayon, polyester, melt blown felt or any other non-woven fabric may be used; woven fabrics may also be used for particular applications. Spunlace is preferred because the nonwoven has loft or fuzz. This requires less tacky adhesive on the back side of the moisture barrier layer which holds the stack in place and provides for easy separation of stacked sheets. It also does a better job collecting debris. Because the bibulous layer 16 is designed to absorb liquid, some embodiments of the present invention include a super absorbent powder additive in the bibulous layer. Examples of the super absorbent powder additives may be found in children's diapers. They are typically gel-like substances which absorb many times their weight in liquid and retain liquid.

Obviously, it is preferred that the moisture absorbed by the bibulous layer 16 is retained by the bibulous layer. That way, once the uppermost sheet 14 becomes soiled, that sheet 14 may be peeled away to reveal a fresh sheet. The moisture barrier layer 18 is operative to prevent transport of liquid out of the bibulous layer 16 into adjacent bibulous layers. The moisture barrier layer 18 may be plastic such as polypropylene or polyethylene. Other examples of materials for the moisture barrier layer include nylon, waterproof paper, Tyvek®, Suralyn and Mylar.

Figure 12:
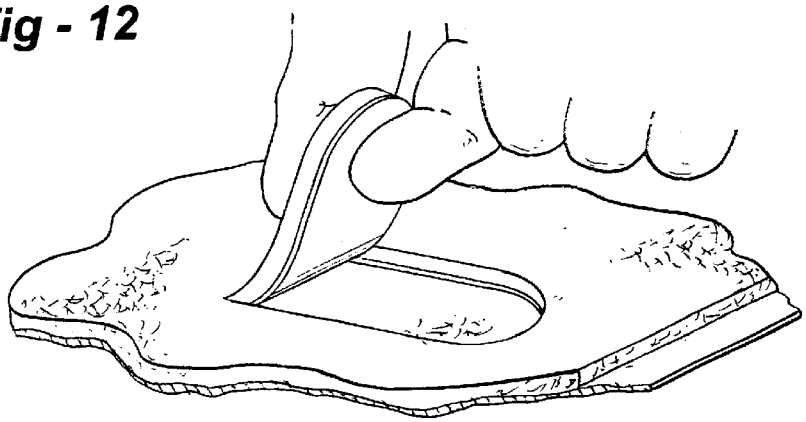
FIG. 12 is a detail view of a tab for use with the various embodiment of the present invention.

As shown in FIG. 2, it is preferred that the moisture barrier layer 18 be coextensive with the bibulous layer 16 and extend somewhat beyond the edges of the absorbent layer 16 so as to define a perimeter portion 24 surrounding the bibulous layer 16. This perimeter portion 24 helps to prevent liquid from running out the sides of the bibulous layer 16 and contaminating underlying bibulous layers. As an alternative to this approach, the perimeter portion 24 of the moisture barrier 18 may be turned up at its edges to better surround the bibulous layer 16. Of course, the moisture barrier layer 18 may be trimmed to match the edges of the bibulous layer 16 and eliminate the perimeter portion 24 if so desired. Also, the moisture barrier layer 18 may be a layer of material applied directly to the underside of the bibulous layer 16. For example, a waterproof coating may be applied to the underside of the bibulous layer. As a further alternative, the moisture barrier layer 18 and bibulous layer 16 may be melt bonded or extrusion bonded to one another rather than interconnected by adhesive 20. In the embodiment of FIGS. 1 and 2, a light layer of adhesive 26 is applied to the underside of the moisture barrier layer 18 in order to interconnect it with the immediately adjacent bibulous layer 16. This adhesive acts to retain the plurality of cleaning sheets 14 in their stacked configuration. To remove an upper soiled layer, a user merely grasps the perimeter portion 24 of the soiled layer and pulls upwardly to remove it from the remaining cleaning sheets. As an alternative, the adhesive 26 on the underside of the moisture barrier layer 18 may be left off in certain areas or around the entire perimeter to ease peeling of the soiled layer. Also, pull tabs or other removal aids may be provided. An example of a pull tab for use with the present invention is shown in FIG. 12. As a further alternative, a portion of the area wherein the layers interconnect may be coated with a release agent or release layer to ease peeling.

Figure 3:
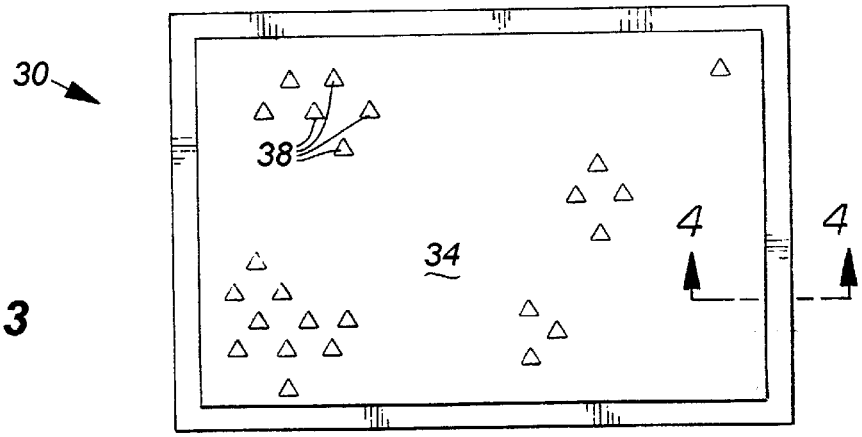
FIG. 3 is a top plan view of a second embodiment of a cleaning mat according to the present invention.
Figure 4:
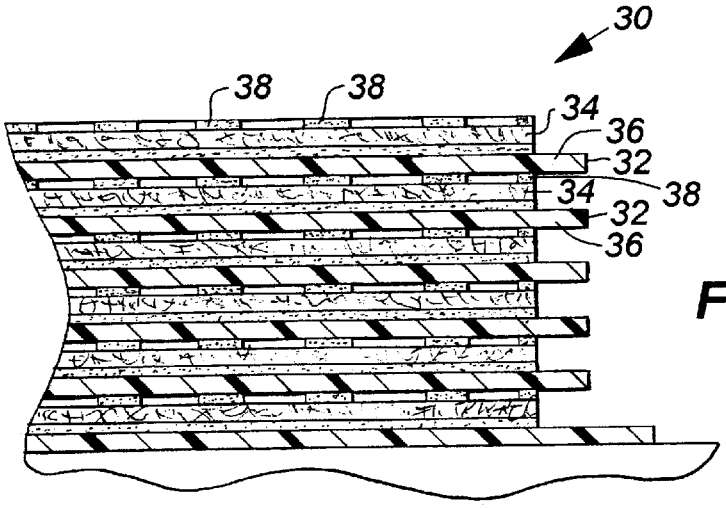
FIG. 4 is a cross-sectional view of a portion of the cleaning mat of FIG. 3 taken along lines 4—4.

Turning now to FIGS. 3 and 4, a second embodiment of a cleaning mat according to the present invention is generally shown at 30. This embodiment differs from the first embodiment shown in FIGS. 1 and 2 in two respects. First, the moisture barrier layers 32 are shown extending further from the edges of the bibulous layers 34 so as to define a larger perimeter portion 36. Secondly, a pattern coated adhesive layer 38 is shown applied to the upper surface of each of the bibulous layers 34. The pattern coated adhesive layer 38 makes the upper surface of the bibulous layer 34 tacky so that dirt and debris is "grabbed" from the soles of shoes and other objects that come in contact with the mat 30. By pattern coating, it is meant that the adhesive layer 38 covers only a portion of the upper face of the bibulous layer 34, so that the absorbency of the bibulous layer 34 is retained.

In FIG. 3, the adhesive layer 38 is shown consisting of a plurality of triangular shaped adhesive patches distributed across the upper surface of the bibulous layer 34. Obviously, other patterns may be used as well. This may include a very light flood coating of adhesive applied to the upper surface of the bibulous layer. While this very light layer could be considered to cover the entire upper surface, the lightness of the layer and the irregular upper surface of the bibulous layer actually cause the adhesive to remain porous such that absorbency is maintained. Alternatively, or in addition to the adhesive, the upper surface of the bibulous layer may be treated so as to have a static charge to further enhance its ability to collect dirt and debris.

As a further possibility, the threads or fiber which make up the woven or non-woven fabric of the bibulous layer may themselves be naturally sticky, or treated or partially coated with a tackifier such that they have some tackiness and grab and retain dirt and debris. As will be clear to those of skill in the art, the pattern coated adhesive may operate to interconnect the various cleaning sheets of the mat 30 such that adhesive on the underside of the moisture barrier layer 32 is eliminated. This is illustrated in FIG. 4. If the bibulous layer consists of fibers which are treated with a tackifier, this adhesive or tackifier by itself may be sufficient to interconnect the bibulous layer with the adjacent moisture barrier layer and/or to retain the cleaning sheets in their stacked configuration.

As a further alternative, with all embodiments of the present invention, the bibulous layers may be impregnated with a solution such as cleaning solution or a germicide. A germicide may also be incorporated in a pattern coated adhesive. Other cleaning materials may also be pattern coated onto the upper surface of the bibulous layers. These various cleaning solutions may act to sterilize or further clean shoes, paws, or wheels. The solution may be applied to the bibulous layer by flooding it, dipping it, or pattern coating it. One example of a cleaning solution is a dusting oil. Also, the bibulous layer may be treated with a perfume or perfume oil.

As mentioned previously, the second embodiment of the cleaning mat 30 also differs from the first embodiment in that the perimeter portion 36 is larger than on the first embodiment. Obviously, these features may be "mixed and matched" among the various embodiments as best suits the application. The larger perimeter portion 36 is illustrated to show how the perimeter can help avoid transport of liquid from one layer to another. Also, in some embodiments of the present invention, the perimeter portions 36 may be adhesively attached to one another so as to seal in the lower bibulous layers. In this way, even complete saturation of the upper bibulous layer or the surrounding floor does not cause wetting of the lower bibulous layers. Also, if some or all of the bibulous layers are coated or impregnated with a cleaning solution, interconnecting the perimeters seals in the solution to avoid premature evaporation.

Figure 5:
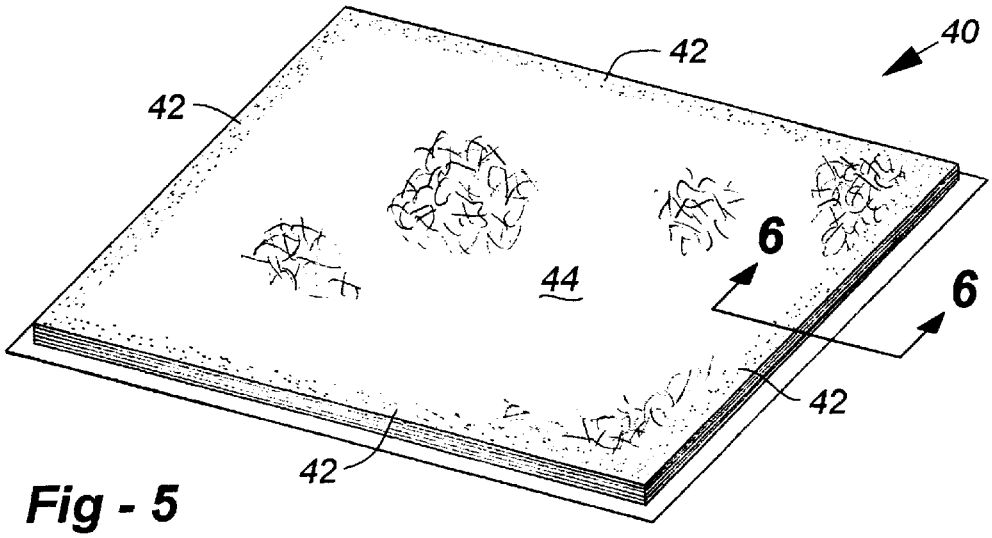
FIG. 5 is a perspective view of a third embodiment of a cleaning mat according to the present invention.
Figure 6:
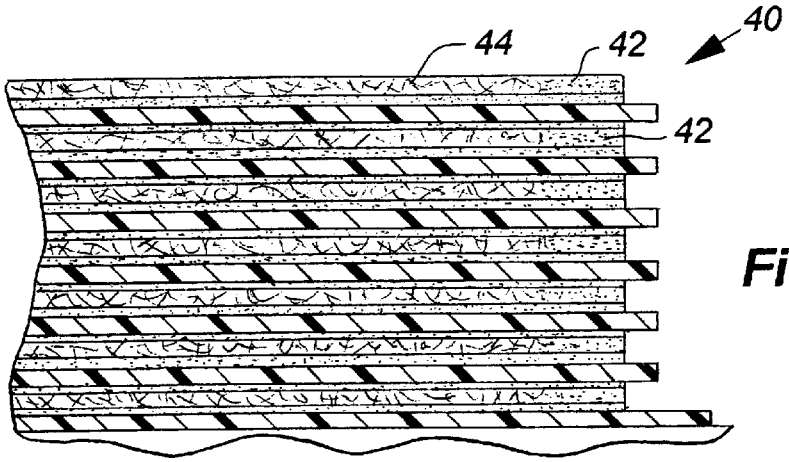
FIG. 6 is a cross-sectional view of a portion of the cleaning mat of FIG. 5 taken along lines 6—6.

Turning now to FIGS. 5 and 6, a third embodiment of a cleaning mat is generally shown at 40. This embodiment differs from the previous embodiments in that the edges 42 of each of the bibulous layers 44 are treated so as to avoid moisture transport out of the edges 42. That is, the edges 42 are treated or impregnated with a substance such as a varnish so as to eliminate the absorbency and moisture transport capability of the edges. In this way, the center portion of the bibulous layer 44 may become saturated and the edges 42 act as sides to retain this liquid in the center. As will be clear to those of skill in the art, this may be accomplished in other ways as well. For example, in a non-woven bibulous layer, the edges may be melted so as to seal the fibers to one another. Other waterproof coatings may also be applied to the edges. This approach may also provide increased strength to the edges preventing fraying or premature wear of the edges.

Figure 7:
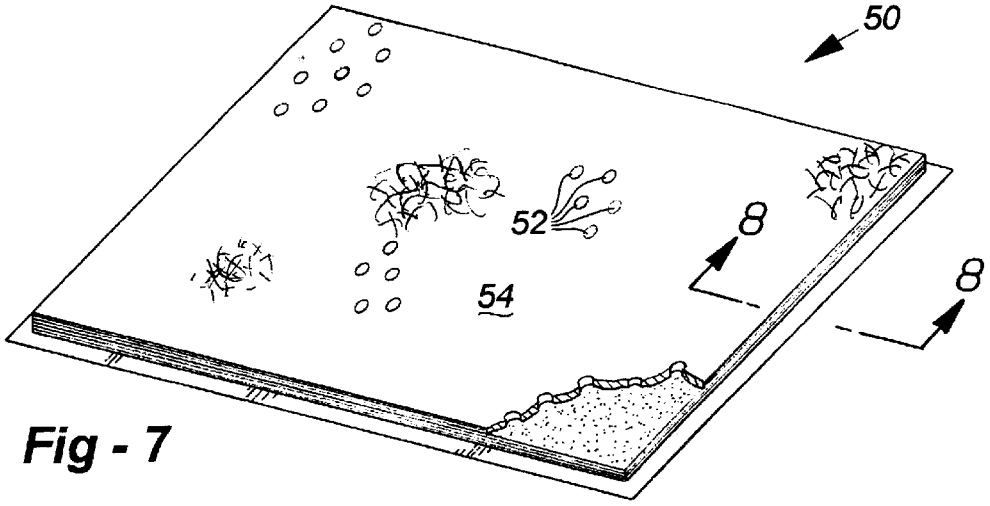
FIG. 7 is a perspective view of a fourth embodiment of a cleaning mat according to the present invention.
Figure 8:
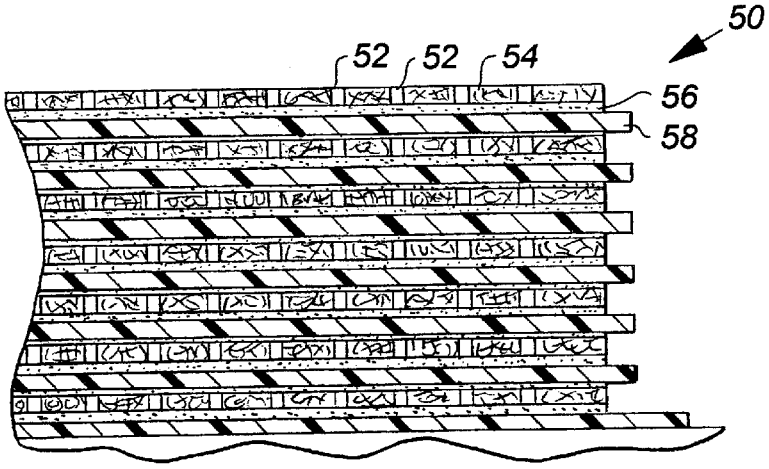
FIG. 8 is a cross-sectional view of a portion of the cleaning mat of FIG. 7 taken along lines 8—8.

Turning now to FIGS. 7 and 8, a fourth embodiment of a cleaning mat according to the present invention is generally shown at 50. For some applications, it is desirable to provide a version of the cleaning mat that is able to retain more dirt and debris. The embodiment 50 of FIGS. 7 and 8 differs from the previous embodiments in that a plurality of perforations 52 are provided through the bibulous layer 54. Though shown only in a few places in FIG. 7, the perforations preferably are provided in all areas of the bibulous layer 54. Alternatively, the edges may not be perforated. As best shown in FIG. 8, the perforations 52 pass entirely through the bibulous layer 54 to the adhesive 56 interconnecting the moisture barrier layer 58 with the bibulous layer 54. Therefore, each of the perforations acts like a little dish or cup with adhesive in the bottom of the cup. Therefore, when someone wipes their feet on the cleaning mat 50, the perforations not only help to catch dirt and debris by providing a rougher upper surface, but also provide "traps" for the dirt and debris. Dirt and debris which falls into the perforations 52 is retained therein by the adhesive 56 in the bottom of the perforations. The upper surface of the bibulous layer 54 may be pattern coated with adhesive, as previously discussed. Together, this makes a highly effective cleaning mat. Obviously, the perforations 52 may be left less deep so that they do not pass all the way to the adhesive 56. This retains the benefit of providing recesses wherein dirt and debris may be captured and providing a rougher upper surface, but does not adhesively retain the dirt and debris in the perforations 52. Alternatively, these less deep perforations could be adhesively coated as part of the pattern coating process so that the perforations do not need to pass entirely through the bibulous layer 54. In the embodiment of the present invention wherein the bibulous layer and the moisture barrier layer are heat bonded together, no adhesive exists at the lower edge of the bibulous layer. In this situation, the perforations lack adhesive bottoms, or adhesive may be added. As a further alternative, the bibulous layer may have two sublayers. The upper sublayer consists of a net or gauze that is relatively open and coated with a tackifier or adhesive. A lower sublayer is solid and; absorbent. This provides a similar effect to pattern coating because the upper sublayer is relatively open so that moisture can still reach the lower absorbent layer. It also provides a somewhat rougher upper surface and areas to trap dirt and debris.

Figure 9:
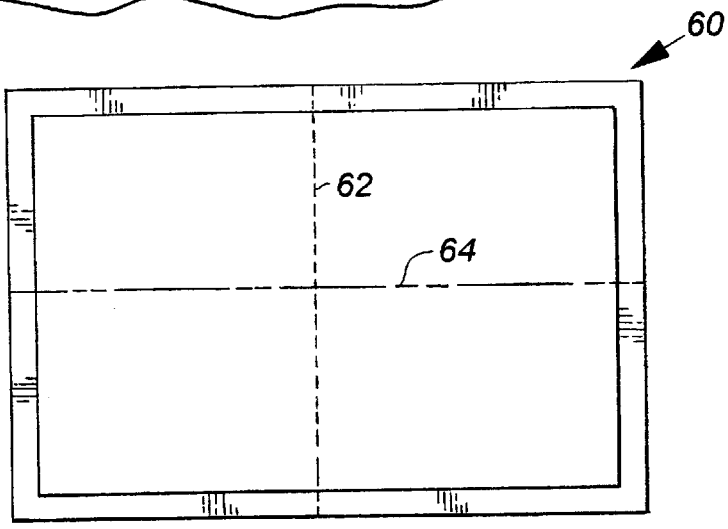
FIG. 9 is a top plan view showing a perforation or serration approach for a cleaning mat according to the present invention to encourage folding the mat.

Turning now to FIG. 9, a top view of a mat 60, which may be any embodiment of the present invention, is shown having a pair of lines bisecting the mat 60 both top to bottom and side to side. Obviously, for some applications, the various mats of the present invention may be large in size. For merchandising purposes, it is preferable that the mat be packageable in a package smaller than the dimensions of the mat. For this purpose, it is desirable to fold the mat. This may be accomplished in several ways. The backing sheet and/or the cleaning sheets may be serrated or completely cut along one of the two lines 62 and 64 shown in FIG. 9. This gives a "relief" along which folding may occur. Also, in the vicinity of the folding area, the pattern coating adhesive may be left off to avoid gluing of the two sides of the fold to one another. Also, a release layer may be provided prior to folding so that the tacky surfaces do not come into contact. In use, the mat 60 would be unfolded and the release layer removed. Where the sheets or the backing sheet are rigid, a score line is particularly preferable because it allows folding.

Figure 10:
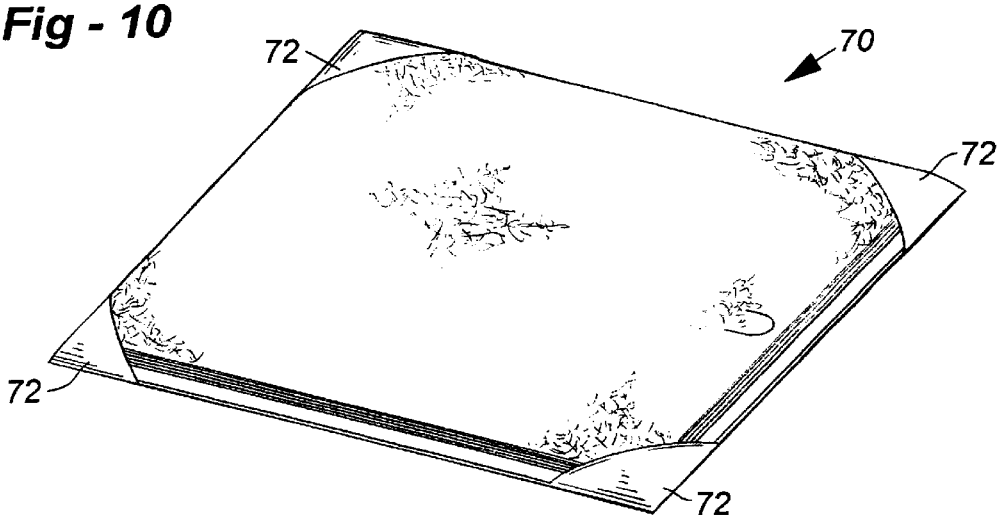
FIG. 10 is a perspective view of a fifth embodiment of a cleaning mat according to the present invention.

Referring now to FIG. 10, a fifth embodiment of the present invention is generally shown at 70. This cleaning mat 70 is similar to the previous embodiments except that instead of adhesive holding the plurality of cleaning sheets in a stacked configuration, four comer tabs 72 are provided at the comers of the backing sheet. Then, the comers of the cleaning sheets may be tucked under these tabs so that they are retained in their stacked configuration. This also provides ease of refill. This operates similar to some desktop calendars which have a cardboard backing sheet and comer pockets into which calendar sheets are tucked for use. As an alternative, the pockets or tabs may extend completely along two or more edges of the backing sheet.

Figure 11:
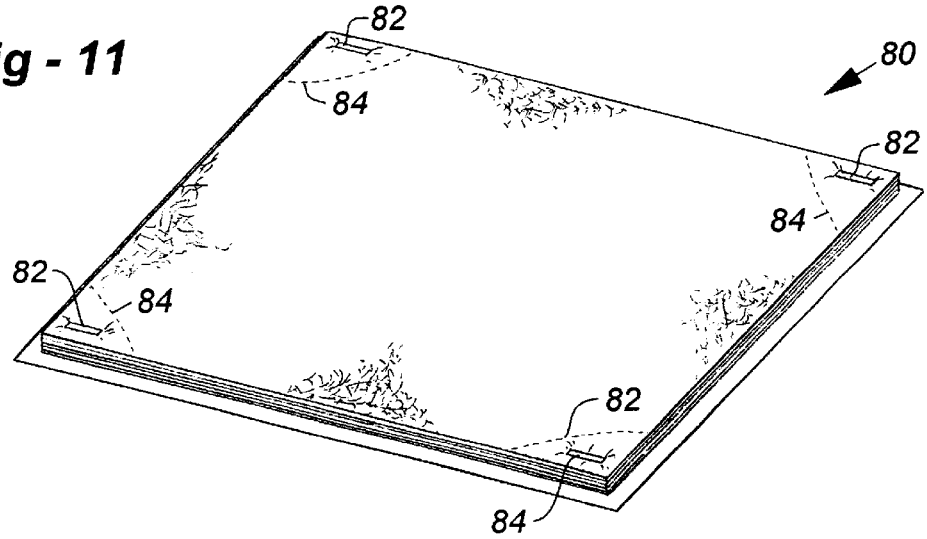
FIG. 11 is a perspective view of a sixth embodiment of a cleaning mat according to the present invention.

FIG. 11 shows yet another approach to maintaining the cleaning sheets in a stacked configuration without the need for adhesive between the individual sheets. In this embodiment of the cleaning mat 80, staples 82 are used to interconnect the cleaning sheets in their stacked configuration. When an uppermost cleaning sheet becomes soiled, it is torn from the staples to expose the next lower sheet. Pieces of cardboard or other stiff material may be used at the comers to strengthen the staple connections. The approaches of FIGS. 10 and 11 may be altered in a variety of ways without departing from the scope of the invention. For example, the corner tabs or pockets may be combined with the staples. In this case, a staple in each corner may be covered by a corner pocket so as to hide the staple. The sheets would first be stapled together and then the corner pocket placed over each corner to hide the staples. The pocket could be held in place in a variety of ways including hot melt glue. Alternatively, the corner pockets may be placed over the corners and then a staple placed through the pockets and the sheets. A label or cover may be placed over the top of the staple to hide it. Also, a double adhesive strip may cover the bottom of the staple to cover it, protect the floor, and hold the mat in place. These same approaches may be applied where edge strips are used in place of corner pockets. As yet another alternative, perforations, as shown at 84 in FIG. 11, may be placed at the comers adjacent the staples to ease removal of soiled sheets. Corner pockets may then cover the staples and the perforations. Also, some adhesive may be placed between the sheets on the embodiments of FIGS. 10 and 11 to assist the staples and/or pockets in stabilizing the stack. As a further alternative with any embodiment of the present invention, the base sheet may define a "frame" for the removable sheets. For example, it may have sloped edges and a recessed center portion wherein the individual sheets may rest.

As discussed with the various embodiments, a backing sheet or base sheet is preferably provided which contacts the floor. It is preferred that the cleaning mat stay in one place during use. For this purpose, the base sheet may be provided with adhesive on its underside so as to retain it in contact and in position on the floor. Alternatively, the backside of the base sheet may be coated with an anti-slip substance such as rubber. The base sheet may be any of a variety of materials such as a heavier cardboard or plastic. Also, the base sheet may merely be an identical or differently sized cleaning sheet as the remaining sheets in the stack. Adhesive on the backside of the base sheet may be protected by a release layer which is removed prior to placing the mat on the floor. Adhesive strips may also be applied to the bottom sheet in one or more spots. A release layer may cover these spots and be removed when the mat is put into place.

The bibulous layers may be modified in various ways depending on the application of the cleaning mat. For example, a scrim or mesh may be included in the construction of the bibulous layer to add strength to the bibulous layer. The scrim can be incorporated so as to slightly pucker the upper surface of the bibulous layer to improve the wiping ability of the upper surface. Also, the present invention has applications other than as a cleaning mat. For example, the mat may be modified so as to be a pet mat whereon a pet such as a dog or cat may rest or sleep. It may also serve as a puppy training pad. For this purpose, the mat may have a very low tack adhesive to retain pet hair deposited by the pet. Also, the bibulous layer may be treated with an attractant to make the mat attractive to the pet. Further, solutions such as cleaning solutions or anti-flea preparations may be added to the pet mat as needed.

As will be clear to those of skill in the art, the illustrated and discussed embodiments of the present invention may be modified in various ways without departing from the scope or teaching of the present invention. It is the following claims, including all equivalents, which define the scope of the invention.

What is claimed is:

1. A cleaning mat for placement on a floor and for cleaning the undersides of shoes, feet, and other objects, said cleaning pad comprising:

a base sheet configured to rest on the floor, said base sheet having an upper surface and a lower surface, said lower surface configured to contact the floor, a plurality of removable and disposable cleaning sheets supported in a stacked configuration on said upper surface of said base sheet, each of said cleaning sheets comprising:

an upper bibulous layer having an upper face, said bibulous layer operative to absorb liquid from an object which contacts said upper face;

a lower moisture barrier layer having an upper face adjacent said bibulous layer, said barrier layer operative to prevent transport of liquid from said bibulous layer to other cleaning sheets below said barrier layer; and an adhesive covering only a portion of said upper face of said upper bibulous layer and operative to grab and retain dirt and debris that comes in contact with said upper face, a portion of said upper face remaining non-occluded such that absorbency is maintained.

2. The cleaning mat according to claim 1, further comprising a plurality of perforations defined through each of said bibulous layers for retaining dirt and debris.

3. The cleaning mat according to claim 1, wherein said bibulous layer and said moisture barrier layer of each cleaning sheet are bonded together with an adhesive.

4. The cleaning mat according to claim 3, wherein said bibulous layer and said moisture barrier layer of each cleaning sheet are bonded together by melting.

5. The cleaning mat according to claim 1, further comprising a moisture absorbing material added to said bibulous layer.

6. The cleaning mat according to claim 1, wherein said moisture barrier layer of each cleaning sheet extends beyond said bibulous layer so as to define a perimeter portion.

7. The cleaning mat according to claim 6, wherein said perimeter portions are adhesively interconnected so as to seal in the unexposed bibulous layers.

8. The cleaning mat according to claim 1, wherein each of said bibulous layers has a perimeter edge, said edge being treated with a moisture barrier material so as to prevent transport of liquid through said edge.

9. A cleaning mat for placement on a floor and for cleaning the undersides of shoes, feet, and other objects, said cleaning pad comprising:

a base sheet configured to rest on the floor, said base sheet having an upper surface and a lower surface, said lower surface configured to contact the floor, a plurality of removable and disposable cleaning sheets supported in a stacked configuration on said upper surface of said base sheet, each of said cleaning sheets comprising:

an upper bibulous layer having an upper face, said bibulous layer operative to absorb liquid from an object which contacts said upper face, said bibulous layer including a plurality of perforations defined therethrough to retain debris; p2 a lower moisture barrier layer having an upper face adjacent said bibulous layer, said barrier layer operative to prevent transport of liquid from said bibulous layer to other cleaning sheets below said barrier layer; and an adhesive layer bonding said bibulous layer to said moisture barrier layer.

10. The cleaning mat according to claim 9, further comprising a moisture absorbing material added to said bibulous layer.

11. The cleaning mat according to claim 9, wherein said moisture barrier layer of each cleaning sheet extends beyond said bibulous layer so as to define a perimeter portion.

12. The cleaning mat according to claim 11, wherein said perimeter portions are adhesively interconnected so as to seal in the unexposed bibulous layers.

13. The cleaning mat according to claim 9, wherein each of said bibulous layers has a perimeter edge, said edge being treated with a moisture barrier material so as to prevent transport of liquid through said edge.

14. The cleaning mat according to claim 9, further comprising an adhesive covering only a portion of said upper face of each of said upper bibulous layers and operative to grab and retain dirt and debris that comes in contact with said upper face, a portion of each of said upper faces remaining non-occluded such that absorbency is maintained.

15. A cleaning mat for placement on a floor and for cleaning the undersides of shoes, feet, and other objects, said cleaning pad comprising:

a base sheet configured to rest on the floor, said base sheet having an upper surface and a lower surface, said lower surface configured to contact the floor, a plurality of removable and disposable cleaning sheets supported in a stacked configuration on said upper surface of said base sheet, each of said cleaning sheets comprising:

an upper bibulous layer having an upper face, said bibulous layer operative to absorb liquid from an object which contacts said upper face; and a lower moisture barrier layer having an upper face adjacent said bibulous layer, said barrier layer operative to prevent transport of liquid from said bibulous layer to other cleaning sheets below said barrier layer, said moisture barrier layer extending beyond said bibulous layer so as to define a perimeter around said moisture barrier layer, said perimeter of each of said cleaning sheets being interconnected by adhesive so as to seal in said bibulous layers that are not exposed.

16. The cleaning mat according to claim 15, further comprising a plurality of perforations defined through each of said bibulous layers for retaining dirt and debris.

17. The cleaning mat according to claim 15, further comprising a moisture absorbing material added to said bibulous layer.

18. The cleaning mat according to claim 15, wherein each of said bibulous layers has a perimeter edge, said edge being treated with a moisture barrier material so as to prevent transport of liquid through said edge.

19. The cleaning mat according to claim 15, further comprising an adhesive covering only a portion of said upper face of each of said upper bibulous layers and operative to grab and retain dirt and debris that comes in contact with said upper face, a portion of each of said upper faces remaining non-occluded such that absorbency is maintained.

20. A cleaning mat for placement on a floor and for cleaning the undersides of shoes, feet, and other objects, said cleaning pad comprising:

a base sheet configured to rest on the floor, said base sheet having an upper surface and a lower surface, said lower surface configured to contact the floor, plurality of removable and disposable cleaning sheets supported in a stacked configuration on said upper surface of said base sheet, each of said cleaning sheets comprising:

an upper bibulous layer having an upper face, said bibulous layer operative to absorb liquid from an object which contacts said upper face;

a lower moisture barrier layer having an upper face adjacent said bibulous layer and an opposing lower face, said barrier layer operative to prevent transport of liquid from said bibulous layer to other cleaning sheets below said barrier layer; and an adhesive covering at least a portion of said lower face of said barrier layer and operative to retain said sheets in said stacked configuration.

* * * * *

UNITED STATES PATENT AND TRADEMARK OFFICE

CERTIFICATE OF CORRECTION

PATENT NO. : 6,458,442 B1
DATED : October 1, 2002
INVENTOR(S) : William D. McKay It is certified that error appears in the above-identified patent and that said Letters Patent is hereby corrected as shown below:

Column 9,
Line 9, delete “p2”.
Line 9, move “a lower moisture” down to the next line.

Column 10,
Line 44, move “an adhesive” down to the next line.

Signed and Sealed this

Thirteenth Day of May, 2003

JAMES E. ROGAN
*Director of the United States Patent and Trademark Office*